US006398888B2

(12) United States Patent
Chattopadhyay

(10) Patent No.: US 6,398,888 B2
(45) Date of Patent: Jun. 4, 2002

(54) HARDENED POROUS AMMONIUM NITRATE

(75) Inventor: Arun Kumar Chattopadhyay, Brossard (CA)

(73) Assignee: ICI Canada, Inc., North York (CA)

( * ) Notice: Subject to any disclaimer, the term of this patent is extended or adjusted under 35 U.S.C. 154(b) by 0 days.

(21) Appl. No.: 09/730,570

(22) Filed: Dec. 7, 2000

Related U.S. Application Data

(63) Continuation of application No. 09/163,183, filed on Sep. 30, 1998, now abandoned, which is a continuation of application No. 08/733,992, filed on Oct. 18, 1996, now abandoned, which is a continuation of application No. 08/547,989, filed on Oct. 25, 1995, now Pat. No. 5,597,977, which is a continuation of application No. 07/878,720, filed on May 4, 1992, now abandoned.

(51) Int. Cl.[7] ..... C06B 31/28
(52) U.S. Cl. ..... 149/46
(58) Field of Search ..... 149/46

(56) References Cited

U.S. PATENT DOCUMENTS 3,366,468 A * 1/1968 Porter ..... 71/35
3,770,390 A * 11/1973 Teot ..... 23/300
3,816,191 A * 6/1974 Wilson et al. ..... 149/41
4,756,738 A * 7/1988 Detroit ..... 71/27

* cited by examiner

*Primary Examiner*—Michael J. Carone
*Assistant Examiner*—Aileen J. Baker
(74) *Attorney, Agent, or Firm*—Pillsbury Winthrop LLP

(57) ABSTRACT

The present invention is directed to hardening ammonium nitrate by combining ammonium nitrate with a functionally active polymer. The functionally active polymer may be combined with ammonium nitrate by itself as a shell or in intermixed with the ammonium nitrate. The invention is found useful in hardening ammonium nitrate for use in explosives.

21 Claims, No Drawings

HARDENED POROUS AMMONIUM NITRATE

This is a continuation of application Ser. No. 09/163,183 filed Sep. 30, 1998 now abandoned which is a continuation of application Ser. No. 08/733,992 filed Oct. 18, 1996, now abandoned which is a continuation of application Ser. No. 08/547,989 filed Oct. 25, 1995, now U.S. Pat. No. 5,597,977, which is a continuation of application Ser. No. 07,878,720 filed May 4, 1992, now abandoned.

BACKGROUND

The present invention is directed to hardening ammonium nitrate prills and granules without affecting other important physical properties.

A problem in the ammonium nitrate art is the competing need for porosity versus the need for hardness. This is especially true for prills or granules that are used for explosive applications. Ammonium nitrate may be used for other applications such as fertilizers, wherein porosity is not an important property, in fact, it is undesirable. Hardness is important for fertilizers since hardness is related to the solubilization rates Therefore, hardness is important for both explosive and fertilizer applications. Those skilled in this art know that, generally, hardening prills for the purposes of storage and/or transportation to their end-use destination has been a problem in this art for sometime.

Hardness for ammonium nitrate prills is generally defined by crushing strength, which is tested by providing a constant load on the prill until the prill is crushed or cracked. The porosity is generally determined in terms of particle density as can be measured by mercury pyknometry.

The present invention advances the ammonium nitrate art with the application of polymers, organic, inorganic and/or combinations thereof to produce a hardened ammonium nitrate unknown to this art. The ammonium nitrate of the present invention may be used for any application where hardness is important. This is especially true for the explosive and the fertilizers arts for use as prills.

SUMMARY OF THE INVENTION

A hardened ammonium nitrate comprised of a combination of a single and/or a plurality of functionally active polymers and ammonium nitrate. The functionally active polymers may be comprised of organic polymers with a range of average molecular weights from about 200 to and through an upper range of 700,000. Preferably, the molecular weight is about 10,000 to and through an upper range of 200,000. Most preferably, the molecular weight is about 60,000 to and through about 150,000. The polymers of this invention may be combined as a homologous series and/or some combination thereof and/or therebetween. Polymers from all organic families are contemplated as useful and operative hereunder. Polymers such as acrylics, vinyl polymers, styrenes, polycarbonates, methacrylates, polypropylene, allyic, copolymers thereof such as maleic anhydride and polystyrene, combinations thereof and/or therebetween. Preferably, acrylics, styrenes, polystyrenes, combinations thereof and/or therebetween. Most preferably, polystyrene. The polymers hereof may be cross-linked, branched, linear, homopolymers, and/or combinations thereof and/or therebetween.

The functional activity provided to the polymer groups may be characterized as associated species. Associated species means any group that is functionally operative within the polymer unit and/or associated thereby which enables film forming with and/or on the ammonium nitrate, ionic association with the ammonium nitrate, sorption on the ammonium nitrate surface, physico-chemical activity with the ammonium nitrate, combinations thereof and/or any chemical or physical force which enables communication between the ammonium nitrate and any of the polymers cited hereinabove.

The functional activity is directed to associate with the ammonium nitrate crystallites. The association relies on the operative mechanisms disclosed hereinabove, and provides the communication between the polymer and the ammonium nitrate. The communication between polymer and ammonium nitrate need not be continuous throughout the polymer/ammonium nitrate interfaces thereby allowing for discontinuity between the two substances. It has been observed that continuous, discontinuous, and combinations thereof and/or therebetween of polymer and ammonium nitrate communications occur in the present invention. Preferably, the communication is a combination of discontinuous and continuous.

The functionally active groups enabling communication are comprised of groups from inorganic species, organic species, and combinations thereof and/or therebetween. The inorganic species may be comprised of combinations of oxygen derived species such as nitrates, sulfates, sulfonates, phosphates, phosphites, phosphonates, and any operable oxyradical and/or oxygen derived species from the first, second, and/or third transition series of the Periodic Chart. Preferably, sulfates, sulfonates, phosphates, and/or phosphonates. Most preferably, sulfonates and/or phosphonates. Organic species may be comprised of carboxylates, amines, hydroxyls, quaternary ammonium species, the di and/or tri combinations thereof, and/or combinations thereof and/or therebetween. Preferably, carboxylates, amines, and/or quaternary ammonium species. Most preferably, amines and/or quaternary amines. Useful combinations of these groups are sulfonates and amines, sulfonates and carboxylates, phosphonates and amines, phosphonates and carboxylates, sulfates and carboxylates, and combinations thereof.

The functionally active group may be introduced into the polymer as radicals or may be formed thereafter, or may be introduced as some ionic species, such as in a moiety, precursors thereof, and/or combinations thereof and/or therebetween. Preferably, the functionally active group is entered into the polymer as a radical. The functionally active group is added from about 0.0001 weight percent to about 10.0 weight percent of the ammonium nitrate, solubilized prior to the beginning of crystallization. Preferably, the functionally active group is added from about 0.0005 to 5.0 weight percent. Most preferably, the functionally active group is added from about 0.01 to about 1.0 weight percent.

Salts of the functionally active groups, such as sulfate and sulfonate salts, may be made as a combination of the polymer and functionally active group. Preferred examples of these salts are the monovalent salts, polystyrene sulfonate, polyvinyl sulfonate, polystyrene sulfonate copolymerized with maleic anhydride.

Optionally, a connecting group may be inserted between the polymer and the functionally active group. The connecting group may be a hydrocarbon of up to 8 carbons. While the present invention contemplates an upper limit of 8 carbons, preferably a linear chain, larger connecting groups may be operable, as well. The connecting group is a means to extend the distance between the polymer and functionally active group. Advantages from that extension may be realized by the addition of other kinds of connecting groups, but functionally the groups provide similar operability.

One of the present inventions more preferable embodiments may be presented by the following formula:

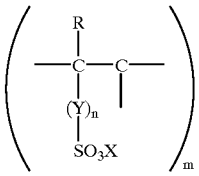

Wherein

Y=connecting group

R=hydrogen or methyl groups n=0 up to 8 m=integer from 3 to 3000

X=alkali metal, ammonium, hydrogen

An advantage to the present invention is its film forming capability. Ammonium nitrate bodies that have been formed by the prior art, may be filmed with the present invention to form an AN prill core/shell spherical or other shape with enhanced hardness. The core may be comprised principally of AN or some combination of AN and some other common explosive and/or fertilizer known to those skilled in this art. Advantageously, the properties of the shell, which are derived from the polymer, may be varied to produce a shell with flexible density and/or hardness. Flexible density means that a range of different densities, either single and/or a plurality thereof, may be coated over a preexisting or as formed prill. The density of the shell may be made to either match the core density and/or increase or decrease the density of the shell relative to the core. Density of the AN prill is an important property in the ultimate product use as an explosive. Density ranges of the shell may be from about 0.5 to about 1.7. The density of the shell may be additionally varied by multi-filming the AN prill to provide a shell of either several films of the same density or a shell of films with a range of varying density.

Thickness of the shell may be on the order of 0.1 up to several millimeters thick. The shell composition may be either the functionally active polymer or a combination of functionally active polymer and AN. The shell composition may be combined with either granules and/or prills. Additionally, there is no requirement that the polymer shell be continuous. As stated hereinabove, it is preferred that the shell be a combination of continuous and discontinuous film. Advantages to the addition of a polymer shell to the preexisting AN core are realized by reconditioning an AN product to be able to withstand certain environmental factors which heretofore would have made the AN prill commercially unusable. Certain environmental factors decrease the shelf-life of AN prill, such as humidity and the mechanical abrasions associated with the shelf and/or shipping environment. The present invention provides enhanced hardness to prolong the shelf-life.

The present invention many also be used to manufacture the core prill body. As those skilled in this art know, the AN prill body is made by internal crystallization of the AN during the formation of the prill. With the addition of the functionally active polymer, the prill should be able to maintain its porosity and increase its hardness throughout the prill body. This enhancement should provide the same shelf-life advantages disclosed hereinabove and additionally should provide the flexibility of density variation imparted by the polymer to the prill body.

It is further found advantageous to mix the product of the present invention with diesel fuel oil, to form an emulsion. The AN prills may be mixed with various ratios such as 30, 45, 60, and 75 percent) of emulsion compositions comprising 80 weight percent aqueous AN liquor, 0.7 weight percent PIBSA—diethanolamine derivative, 0.7 weight percent sorbitan monooleate and 4.6 weight percent diesel fuel oil. The emulsions are made under low shear mixing conditions and produced to an average size of about 5 microns.

Generally, the means of combining the present invention is to place a polymer salt and ammonium nitrate ("AN") in a carrier solvent such as water to make a mixture, heat the mixture to solubilization to form the combination, disperse the combination by some means and slowly cool over time to room temperature to form prills and/or granules.

DETAILED DESCRIPTION OF EMBODIMENTS

The following is a further description of the present invention. The intent of this description is to further illustrate the invention and is not intended to limit the scope thereof.

EXAMPLE 1

In Example 1, 950 grams of commercially available AN (ammonium nitrate) was added to 40 grams of water and 10 grams of an aqueous solution of sodium polystyrene sulfonate (SPSS) approximately 0.2 weight percent, with a molecular weight of about 75,000 (obtained from Aldrich Chemicals, Milwaukee Wis.) subsequently charged into a jacketed vessel and melted at 130 degrees centigrade forming a liquor. The liquor was sprayed on to 1 kilogram of freshly made hot (50 to 70 degrees C.) AN prills over a period of 10 to 15 minutes in a thermally jacketed rotating pan. After completion of spraying the pan was heated by steam for 30 to 40 minutes in order to drive off moisture from the prills. The temperature decreased to room temperature over a 30 to 40 minute time period. The AN granules made from this method showed both porosity, enhanced hardness, and low friability.

EXAMPLE 2

In Example 2, the same procedure was used as in Example 1, except that 0.3 weight percent SPSS was added to the AN solution. The resulting AN granules exhibited the same improvements.

EXAMPLE 3

In Example 3, the same procedure was used as in Example 1, except that 1187.5 grams of AN, 50 grams of water, and 12.5 grams of SPSS with a molecular weight of about 130,000 (obtained from National Starch Chemical, New Jersey) was charged into the jacketed vessel.

EXAMPLE 4

In Example 4, the same procedure was used as in Example 1, except 15 grams in 20% aqueous solution (0.3 weight percent) of polyvinyl sulfonate (obtained from Air Products, Pennsylvania) with a molecular weight of approximately 70,000 was added to the mixture.

EXAMPLE 5

Example 5, is an example of the use of the present invention in the manufacture of prill. A hot liquor containing 95 weight percent AN, 1 weight percent SPSS (20% aqueous solution) and 4 weight percent water may be made in a tank of 200 Kg capacity at 140 degrees C. The hot liquor may be pumped to an overhead tank of a prilling tower with a height of 8 meters and then may be sprayed through a vibrated sieved plate to produce a shower of droplets with an average diameter of 1.7 mm. The droplets so formed will fall through a moving air stream and solidify during flight. The solidified droplet is the prill.

The following methods were used to determine the properties of the present invention.

Particle density of the granules/prill was measured by mercury pyknometry measured in grams per cubic centimeter. This technique provides semi-quantitative results of the voids present. It is a good technique when comparisons are made on a sample to sample basis. Samples are placed in a holder and mercury is pumped into the holder with the sample. The resulting volume differential between mercury with and without sample is used to determine the sample density.

Crushing strength, which is a measure of hardness, is determined by placing a constant load on a sample until the sample either cracks or is crushed and is measured in pounds. The data is taken on a TSDC Chatillon obtained from Digital Measurement Metrology Inc. in Canada.

Friability is a measure of the abrasion resistance of the ammonium nitrate body which is dependent upon the compactness of the crystal structure at the surface of the body. Friability is determined by the percent fines (powder which comes off the body) generated after the body is subjected to an air cyclone. This is a standard method, known to those skilled in the art and gives a measure of surface hardness.

The Table exhibits results from tests performed on the present invention.

| Example | Crushing Strength | Friability | Particle Density |
|---|---|---|---|
| 1 | 5.7–6.8 | 0.5–3.5 | 1.17 |
| 3 | 6–6.72 | 0.5–3.5 | 1.18 |
| 4 | 3.8 | 5–8 | |
| Comparative Example | | | |
| 1A | 2.1 | 18 | 1.23 |
| 3A | 2–3 | — | 1.46 |
| 4A | 2–3 | — | 1.46 |

The Table indicates that hardness or crushing strength is increased for the samples treated with the functionally active polymers since the samples were able to withstand a larger crushing weight. The increase in hardness is from two to three times the hardness of the comparative examples. Note that the density of the inventive samples is less than that of the comparative samples by a significant amount, indicating that the inventive samples do not derive their hardness from density considerations.

I claim:

1. A hardened ammonium nitrate prill which is suitable for use in an explosive and which is formed by spraying and solidifying an aqueous solution of ammonium nitrate and functionally active polymer, wherein said functionally active polymer comprises polymer selected from the group consisting of acrylics, vinyl polymers, styrenes, polypropylene, allylic, copolymers thereof, and combinations thereof, said polymer having multiple pendant sulfonate groups.

2. The hardened ammonium nitrate prill of claim 1, wherein said polymer is selected from the group consisting of polystyrene sulfonate, polyvinyl sulfonate, and polystyrene sulfonate copolymerized with maleic anhydride.

3. The hardened ammonium nitrate prill of claim 2, wherein said polymer is sodium polystyrene sulfonate.

4. The hardened ammonium nitrate prill of claim 1, wherein said polymer has the formula:

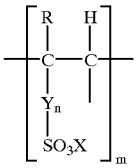

wherein,

Y is a connecting group,

R is hydrogen or a methyl group, m is an integer from 3 to 3000, n is an integer from 0 to 8, and X is an alkali metal, ammonium or hydrogen.

5. The hardened ammonium nitrate prill of claim 4, wherein Y is a hydrocarbon group having up to 8 carbon atoms.

6. The hardened ammonium nitrate prill of claim 1, wherein said polymer has an average molecular weight of from 200 to 700,000.

7. The hardened ammonium nitrate prill of claim 1, wherein said polymer has an average molecular weight of from 10,000 to 20,000.

8. The hardened ammonium nitrate prill of claim 1, wherein said polymer has an average molecular weight of from 60,000 to 150,000.

9. An ammonium nitrate body which is suitable for use as an explosive and which has a core/shell structure comprising a core and an outer layer, wherein said core comprises an ammonium nitrate prill; and said outer layer comprises a hardened ammonium nitrate formed by spraying and solidifying an aqueous solution of ammonium nitrate and functionally active polymer, said functionally active polymer comprising polymer selected from the group consisting of acrylics, vinyl polymers, styrenes, polypropylene, allylic, copolymers thereof, and combinations thereof, said polymer having multiple pendant sulfonate groups.

10. The ammonium nitrate body of claim 9, wherein said core is a preexisting ammonium nitrate prill reconditioned by addition of said outer layer.

11. The ammonium nitrate body of claim 9, wherein said polymer is selected from the group consisting of polystyrene sulfonate, polyvinyl sulfonate, and polystyrene sulfonate copolymerized with maleic anhydride.

12. The ammonium nitrate body of claim 11, wherein said polymer is sodium polystyrene sulfonate.

13. The ammonium nitrate body of claim 9, wherein said polymer has the formula:

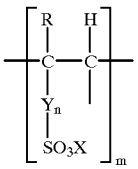

wherein,

Y is a connecting group,

R is hydrogen or a methyl group, m is an integer from 3 to 3000, n is an integer from 0 to 8, and X is an alkali metal, ammonium or hydrogen.

14. The ammonium nitrate body of claim 13, wherein Y is a hydrocarbon group having up to 8 carbon atoms.

15. The ammonium nitrate body of claim 9, wherein said polymer has an average molecular weight of from 200 to 700,000.

16. The ammonium nitrate body of claim 9, wherein said polymer has an average molecular weight of from 10,000 to 200,000.

17. The ammonium nitrate body of claim 9, wherein said polymer has an average molecular weight of from 60,000 to 150,000.

18. An emulsion comprising a hardened ammonium nitrate prill as claimed in claim 1.

19. An explosive comprising a hardened ammonium nitrate prill as claimed in claim 1, and diesel fuel.

20. An emulsion comprising an ammonium nitrate body as claimed in claim 9.

21. An explosive comprising an ammonium nitrate body as claimed in claim 9.

* * * * *